US005916472A

United States Patent [19]

Urlau et al.

[11] Patent Number: 5,916,472

[45] Date of Patent: Jun. 29, 1999

[54] IMMERSED OUTLET FOR CASTING METAL

[75] Inventors: Ulrich Urlau, Moers; Herbert Förster, Düsseldorf; Wolfgang Reichelt, Moers; Jürgen Schemeit, Langenfeld, all of Germany

[73] Assignee: Mannesmann Aktiengesellschaft, Düsseldorf, Germany

[21] Appl. No.: 08/930,026

[22] PCT Filed: Mar. 4, 1996

[86] PCT No.: PCT/DE96/00405

§ 371 Date: Sep. 22, 1997

§ 102(e) Date: Sep. 22, 1997

[87] PCT Pub. No.: WO96/29166

PCT Pub. Date: Sep. 26, 1996

[30] Foreign Application Priority Data

Mar. 21, 1995 [DE] Germany ..... 195 12 208

[51] Int. Cl.[6] ..... B22D 41/50

[52] U.S. Cl. ..... 222/594; 222/606

[58] Field of Search ..... 222/594, 606, 222/607; 164/337, 437; 266/236

[56] References Cited

U.S. PATENT DOCUMENTS

| | | | |
|---|---|---|---|
| 5,314,099 | 5/1994 | Butz et al. | 222/606 |
| 5,429,283 | 7/1995 | Luhrsen et al. | 222/606 |
| 5,547,014 | 8/1996 | Bruckner et al. | 164/437 |
| 5,681,498 | 10/1997 | Poloni et al. | 222/594 |
| 5,716,538 | 2/1998 | Poloni et al. | 222/606 |

*Primary Examiner*—Scott Kastler

*Attorney, Agent, or Firm*—Cohen, Pontani, Lieberman & Pavane

[57] ABSTRACT

The invention is directed to an immersion nozzle for casting metal, especially steel, in plants for the continuous casting of thin slabs. On order to provide an immersion casting pipe that is easy to manufacture, has a long life, and enables the liquid metal to flow out in a uniform manner, it is suggested, according to the invention, that the pour-in part (11) is a pipe having a straight-surface front mouth (12), and the pour-out part (21) is constructed from plane-surface wall elements (22, 23). For this purpose, the circular cross-sectional area ($A_R$) of the pour-in part (11) is in a relationship to the rectangular free cross-sectional area ($A_E$) of the pour-out part (21) such that $A_R/A_E \geqq 1.7$.

14 Claims, 4 Drawing Sheets

IMMERSED OUTLET FOR CASTING METAL

FIELD OF THE PRESENT INVENTION

The present invention is directed to an immersed outlet (also referred to as an immersion casting pipe or an immersion nozzle) for casting metal, especially steel, in plants for the continuous casting of thin slabs, with a pour-in part which is fastened at a pour-in or casting vessel and which has a circular cross section, and with a pour-out part which dips into the melt located in a rectangular mold, the mouth of the pour-out part being rectangular in cross section.

BACKGROUND OF THE INVENTION

An immersion nozzle, especially for casting thin slabs, is known from EP 0 630 712. This immersion nozzle is divided into two portion, and the length of its lower shaped brick is substantially greater than its width. The individual portions are formed by separate shaped bricks, wherein the shaped bricks engage in one another at their ends which face one another and a seal is arranged between the meshing ends of the shaped bricks.

The individual shaped bricks have a complicated shaped construction with distinct differences in wall thickness.

DE 37 09 188 A1 likewise discloses a pour-out pipe for metallurgical vessels. The upper longitudinal portion of the pour-out pipe is round in cross section and its lower longitudinal portion is rectangular in cross section. The dimensions in the mouth region have a length-to-width ratio of 20:1 to 80:1. The outlet of the immersion casting pipe is formed by two mouth openings which together have a flow cross section which is not quite as large as the flow cross section at the stopper end.

A ratio of less than 1:1 between the flow cross section in the inlet pipe and at the outlet of the immersion casting pipe is achieved by flow deflection and by narrowing two mouth openings.

SUMMARY OF THE INVENTION

The object of the invention is to provide an immersion nozzle which is easy to manufacture, has a long life, has a construction which is resistant to thermal stresses with respect to manufacture and operation, and enables the liquid metal to flow out in a uniform manner.

The immersion nozzle is constructed from two basic structural component parts, namely a tubular pour-in part and a rectilinear or straight-surface pour-out part. Provided between these two basic structural component parts, which are completely different from one another with respect to shape, is a transition of short overall length.

Surprisingly, transition has virtually no effect on the flow behavior of the liquid steel flowing through the immersion nozzle insofar as the pour-out part is formed from plane-surface wall elements and has a free cross-sectional area which is less than half of the cross-sectional area of the pour-in part.

Regardless of the shape of the transition from the tubular pour-in part to the rectangular pour-out part, the flow of molten steel can be conducted so as to be completely calm insofar as the plane-surface wall elements are arranged virtually parallel to one another.

As a result of the simple shaped elements which are, specifically, either round or rectilinear, the individual structural component parts of the immersion nozzle are adapted to the anticipated high thermal stresses. In addition to the simple geometrical shape, wall elements of identical thickness are used.

Since the transition between the pour-in part and the pour-out part is of secondary importance to the flow ratios, constructional freedom can be exploited for purposes of optimization with respect to freeing the transition part from stresses.

A positive influence can be exercised on the flow ratios especially in the transition region by baffle or deflector elements arranged at the base of the pour-in part.

The complete calming of the flow behavior in the melt which is achieved by the simple shape of the pour-out part enables the required throughput quantities to be produced in the casting of thin slabs while minimizing the free outlet area.

The requirement for small surface area makes it possible to use immersion nozzles for thin-slab molds with parallel side walls and a width of up to 60 mm.

Owing to the identical shaping of the mouth of the immersion nozzle and the inlet of the mold, a constant free surface of the level of the melt located in the mold adjusts to the dimensions of the mold.

Due to the calmed, uniform guiding of the melt in the pour-out part of the immersion nozzle and the similarly shaped pour-out part and mold having only slight differences between them with respect to their cross-sectional area, the melt is guided in the mold with little whirling. The melt is adjusted with respect to amount via an adjusting member in the casting vessel, normally via a stopper end.

DETAILED DESCRIPTION OF THE PRESENTLY PREFERRED EMBODIMENTS

Figure 1:
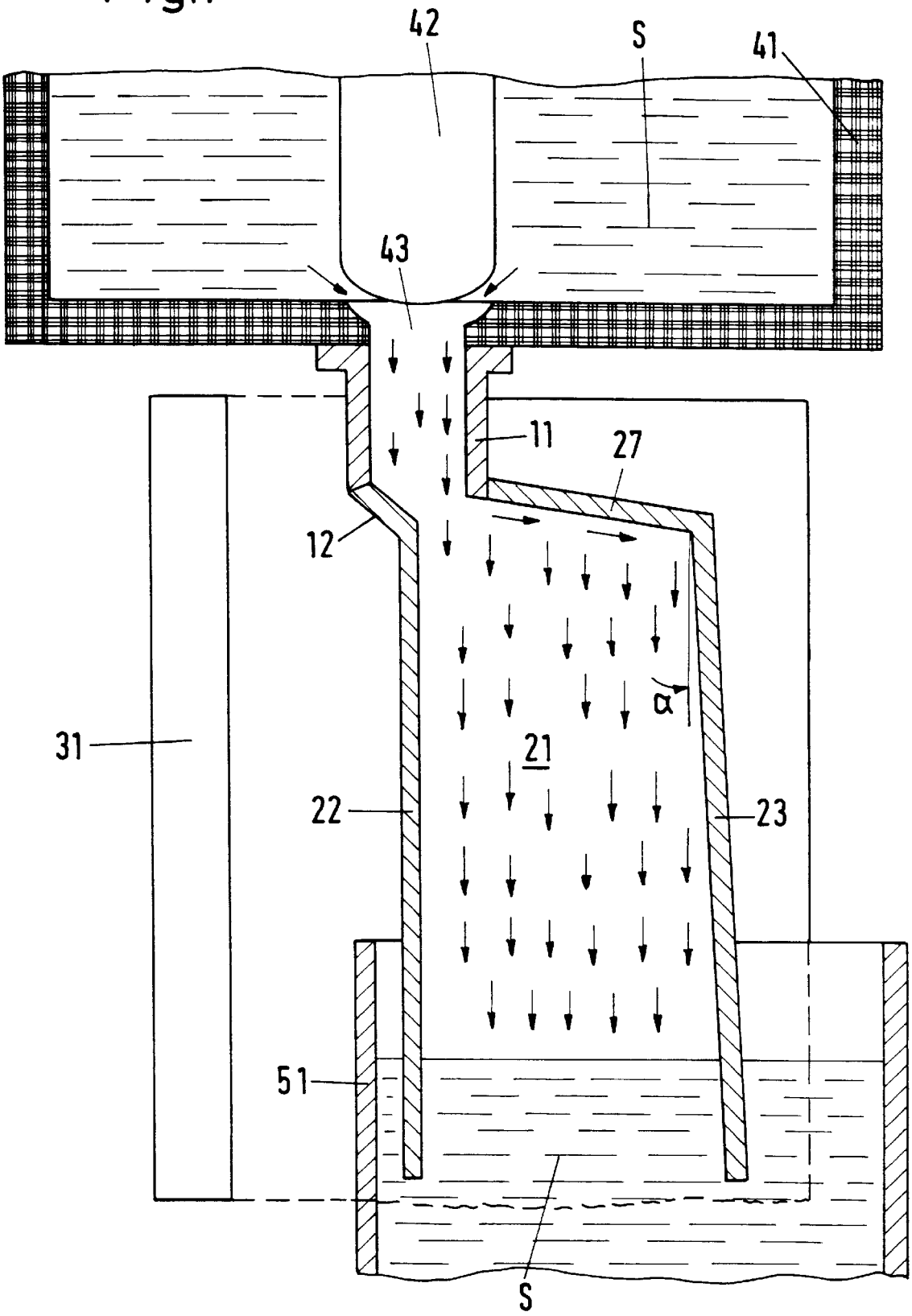
FIG. 1 is a basic diagram of the immersion nozzle and the casting vessel.

FIG. 1 shows a section of a casting vessel 41 with the outlet opening 43 which can be blocked or narrowed by a stopper 42.

An immersion nozzle 10 includes a pour-in part 11 having the shape of a pipe and with plane end faces on the outlet side is fastened at the outside of the base of the casting vessel 41.

The pour-in part 11 is connected with the a substantially rectangular pour-out part 21. On the outlet side, the pour-out part 21 dips into a melt S in a mold 51.

The pour-out part 21 has broad sides 22, and narrow sides 23, shown on the right-hand side of the drawing, and an end wall 27 at the junction between the pour-in part 11 and pour-out part 21. At least the add a pour-out part is formed of a material which is heatable by means of energy that can be supplied externally. For this purpose, the material can be a refractory material in which are embedded metallic elements which are heatable by means of electrical energy.

Further, a heating device 31 is guided substantially parallel to the broad sides 22.

The broad sides 22 and the narrow sides 23 are guided so as to be substantially parallel to one another and have a distance a relative to one another with respect to a distance b of the narrow sides 23 in the mouth region of the immersion casting pipe such that $a<1/35\times b$. The right-hand side of the FIG. 1 shows a configuration of the pour-out part 21 in which the narrow sides 23 spread in the direction of flow at an angle a of less than 7°.

Figure 2:
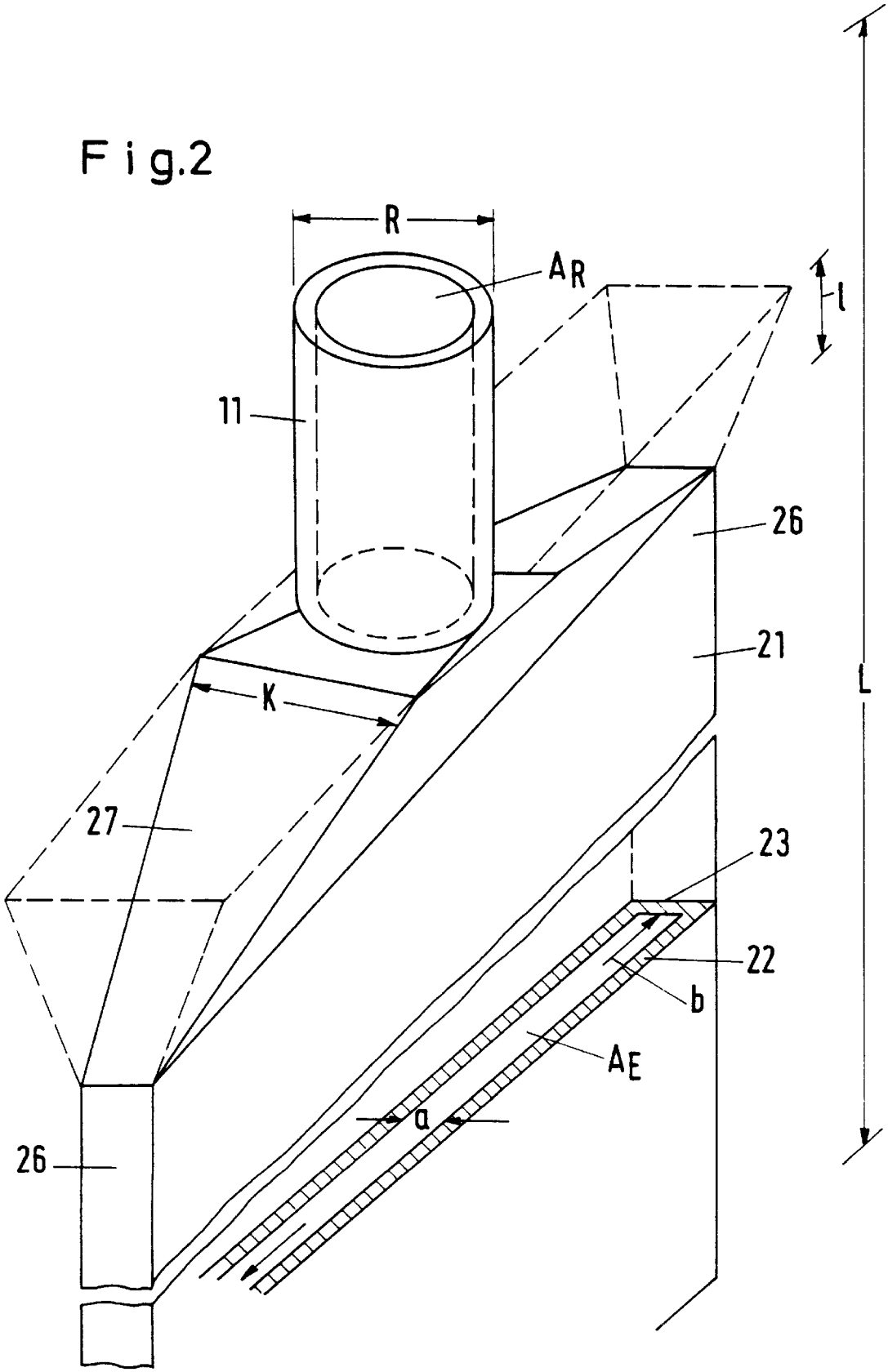
FIG. 2 shows an immersion nozzle with a spreading of the immersion casting part at the head end.
Figure 4:
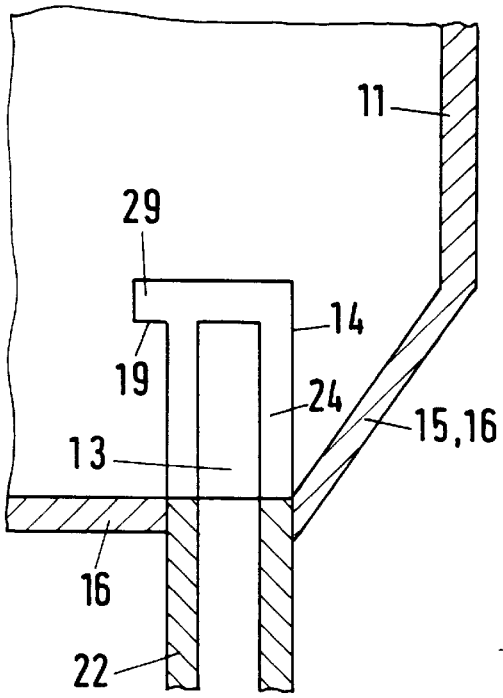
FIG. 4 shows the detail of the transition between the pour-in part and pour-out part.

FIG. 2 is a perspective view of a pour-out part 21 whose broad sides open conically opposite to the direction of flow at the head end until reaching an inner width K. This inner width K is in a relationship to the outer diameter R of the round pour-in part 11 such that K/R=0.9–1.2. As is shown in the diagram, a square with edge length K extends in the center, on which the end face 12 of the tubular pour-in part 11 can be placed or can even inserted through an opening of suitable size. The end wall 27 can be formed so as to narrow conically proceeding from edges K.

In an open section, FIG. 2 shows the free cross-sectional area of the pour-out part $A_E$ which is calculated from the distance a between the broad sides multiplied by the distance 6 between the narrow sides. The cross-sectional area $\mathbf{22}_R$ of the pour-in part 11 is in a relationship to the rectangular free cross-sectional area $A_E$ of the pour-out part 21 such that $A_R/A_E \rightarrow 1.7$.

Also shown in the Figure is the length of the transition part 1, whose relationship to the distance between the broad sides a is such that $I/A<1/4$.

The overall length of the immersion casting pipe formed of the pour-in part 11 and the pour-out part 21 is designated by L.

Figure 3:
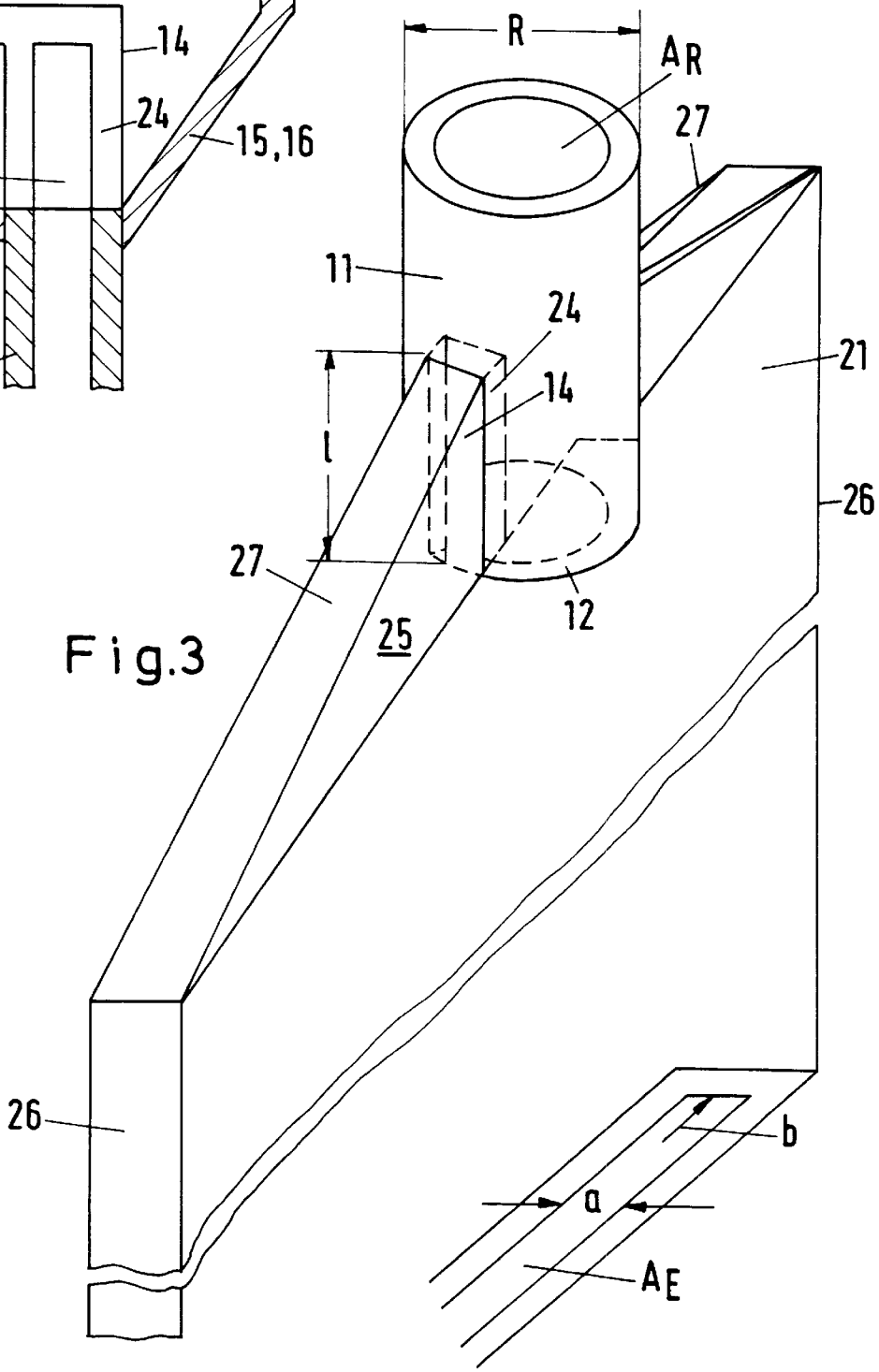
FIG. 3 shows another embodiment of the immersion nozzle of FIG. 1 with a roof-shaped pour-out part.

FIG. 3 shows of an immersion nozzle in which the pour-out part has a roof-shaped head end 24 of which fits into a slot 14 of the pour-in part 11 at the head end in the central region. A head 25 of the pour-out part 21 has an end wall 27 which opens in a roof-shaped manner from the pour-in part in the conveying direction to the edge of the broad sides 22.

The slot 14 of the pour-in part 11 or of the roof shaped head end 24 of the pour-out part 21 corresponding to the slot 14 has a length l.

FIG. 2 shows a detail of the mouth region 13 of the pour-in part 11. The slot 14 in the pour-in part into which the roof-shaped head end 24 fits is shown from the top. A tongue 29 which fits into a groove 19 of the pour-in part 11 is provided at the part 24. The arrangement of the groove 19 tongue 29 enable the pour-in part 11 and 21 pour-out parts to slide together horizontally; during operation, however, the pour-out part 21 is prevented from falling out of the slot 14 of the pour-in part 11.

The mouth region 13 of the tubular pour-in part 11 can be closed by a deflector element 16 which is arranged either vertically to the flow direction of the liquid metal or has a flattened portion 15 as is shown on the right-hand side of the Figure.

Figure 5:
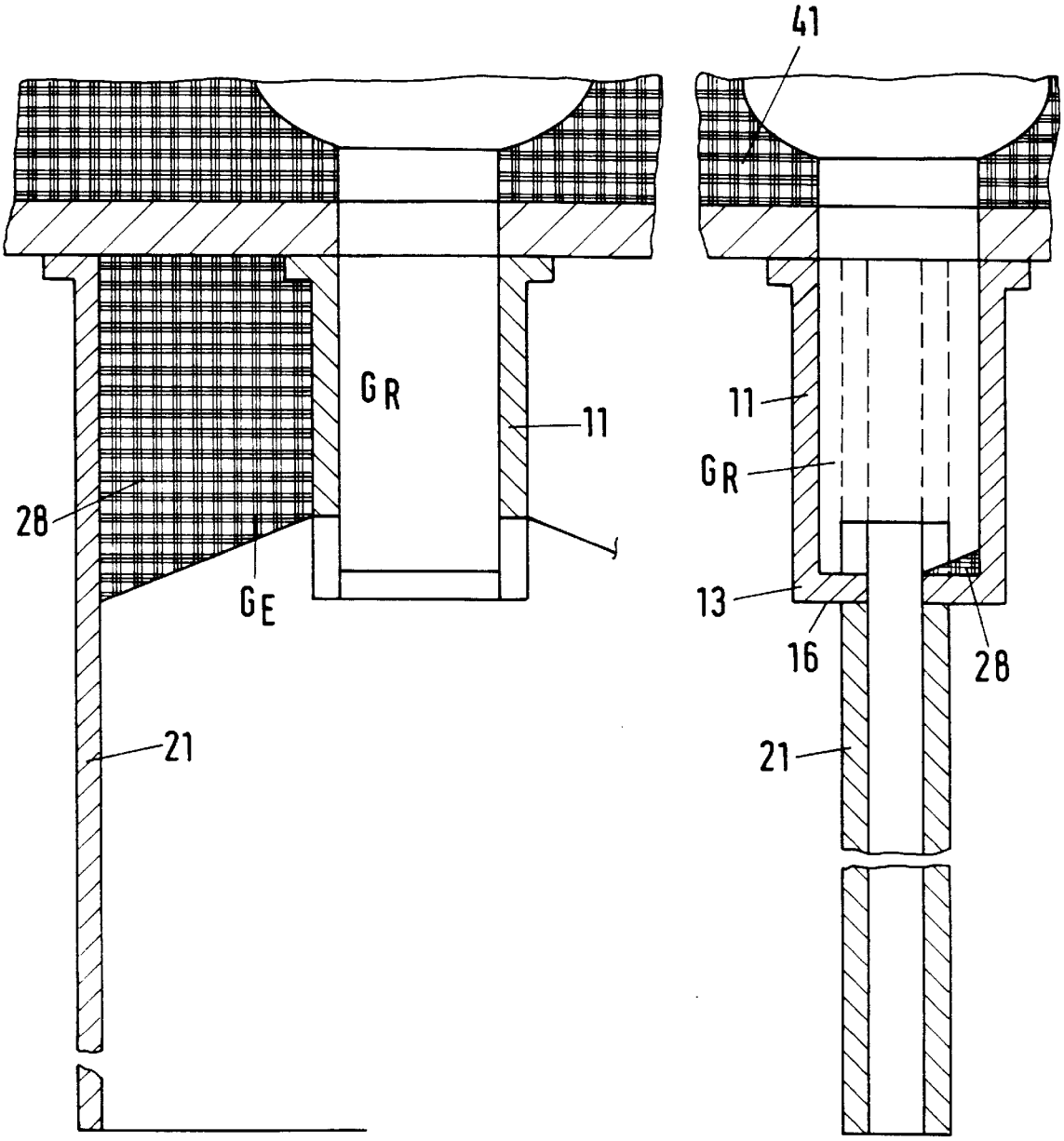
FIG. 5 shows the arrangement of the pour-in part and pour-out part at the casting vessel.

FIG. 5 shows an immersion nozzle with a pour-out part 21 which is fastened at the casting vessel 41 completely independent from the pour-in part 11.

The pour-in part 11 which is arranged directly below the outlet opening 43 of the casting vessel 41 is enclosed by an insert 28 in the casting space $G_E$ of the pour-out part 21. The insert 28 is shaped such that the flow of melt exiting the tubular pour-in part 11 is guided in a suitable manner without whirling.

The narrow sides are shown in figure. The pour-in part 11 has deflector elements 16 in the mouth region 13 which narrow conically in the direction of flow in the right-hand side of the picture, for example, through inserts 28, and which close the projecting portion of the pour-in part 11. This configuration the metal melt, of deflector element 16 enable (not shown) which has a round cross section after exiting the outlet opening 43, to be compelled along the shortest possible path to form a metal flow having a rectangular cross-sectional area with a large ratio of narrow sides to broad sides.

What is claimed is:

1. An immersion nozzle for transferring melt from a casting vessel to a rectangular mold for the continuous casting of thin slabs of metal, comprising:

a pour-in part comprising a pipe having a circular cross-section, a pour-in part input end fastened to a bottom of the casting vessel, and a pour-in part output end;

a transition part connected to said pour-in part output end;

a pour-out part connected to said transition part such that the melt flows downwardly through said transition part to said pour-out part and said pour-out part having a mouth which is suspended in the melt in the rectangular mold, said mouth being substantially rectangular in cross-section, said pour-out part comprising planar-surface wall elements including a pair of parallel broad sides and a pair of parallel narrow sides;

said pour-in part and said pour-out part having a constant wall thickness; and a ratio of an area $A_R$ of said circular cross-section of said pour-in part to an area $A_E$ of said rectangular cross-section of said mouth of said pour-out part being $A_R/A_E \leqq 1.7$.

2. The immersion nozzle of claim 1, wherein said pair of substantially parallel broad sides are separated by a first distance (a), said pair of narrow sides are separated by a second distance (b) at said mouth of said pour-out part, and said first distance (a) being related to said second distance (b) by $a<1/35\ b$.

3. The immersion nozzle of claim 2, wherein said pair of narrow sides spread apart toward said mouth of said pour-out part at an angle $\alpha<7°$.

4. The immersion nozzle of claim 2, wherein said transition part between said pour-in part output end and said pour-out part planar surface wall elements has a length (l) defined by $l/a<1/4$.

5. The immersion nozzle of claim 4, wherein said pour-in part output end includes a slot and said transition part comprises an extension of said planar surface wall elements engageable with said slot.

6. The immersion nozzle of claim 5, wherein said extension comprises a roof-shaped head comprising roof-shaped sides extending conically from a top of said slot to said pair of narrow sides.

7. The immersion nozzle of claim 5, wherein said pour-in part output end comprises a flattened portion from a top of said slot to outer edges of said broad sides operatively guiding said melt toward said pour-out part.

8. The immersion nozzle of claim 4, wherein said transition part comprises extensions from said pair of broad sides opening conically from a top of said pair of broad sides to said pour-in part output end whereat said extensions are separated by a width (K) related to an outer diameter (R) of said pour-in part such that K/R is ion the range of about 0.9 to 1.2.

9. The immersion nozzle of claim 8, wherein said transition part further comprises roof-shaped sides connecting said pour-in part output end, an outer edge at a top of each of said pair of narrow sides, and said extensions, wherein each of said pair of roof-shaped sides has a width (K) at said pour-in part output end and a width equal to said first distance (a) where said each one of said pair of roof shaped sides meets said outer edge.

10. The immersion nozzle of claim 4, wherein said pour-in part output end comprises a groove and said pour-out part comprises a tongue for operative engagement with said groove for connecting said pour-in part to said output part.

11. The immersion nozzle of claim 5, wherein said pour-out part comprises a length (L) substantially equal to a total length of said immersion nozzle, said pour-in part being in loose contact with said pour-out part and said immersion nozzle comprising inserts which define a casting space within said pour-in part and said pour-out part.

12. The immersion nozzle of claim 11, wherein said inserts comprise a first insert that encloses said pour-out part and a second insert in said mouth of said pour-in part operatively narrowing a passage in said pour-in part toward said pour-in part output end for minimizing a whirling of said melt in said immersion nozzle.

13. The immersion nozzle of claim 1, wherein said pour-in part output end comprises a deflector.

14. The immersion nozzle of claim 1, wherein said material comprises a refractory material having embedded metallic elements heatable by electrical energy.

* * * * *